US009623549B2

(12) United States Patent
Chang

(10) Patent No.: US 9,623,549 B2
(45) Date of Patent: Apr. 18, 2017

(54) ROTARY WRENCH

(71) Applicant: Chih-Min Chang, Changhua County (TW)

(72) Inventor: Chih-Min Chang, Changhua County (TW)

( * ) Notice: Subject to any disclaimer, the term of this patent is extended or adjusted under 35 U.S.C. 154(b) by 304 days.

(21) Appl. No.: 14/462,936

(22) Filed: Aug. 19, 2014

(65) Prior Publication Data

US 2016/0052123 A1 Feb. 25, 2016

(51) Int. Cl.
*B25G 1/06* (2006.01)
*B25G 1/10* (2006.01)

(52) U.S. Cl.
CPC ..... *B25G 1/066* (2013.01); *B25G 1/105* (2013.01)

(58) Field of Classification Search
CPC ..... B25B 13/48; B25B 13/461; B25G 1/025; B25G 1/04; B25G 1/06; B25G 1/066; B25G 3/38
See application file for complete search history.

(56) References Cited

U.S. PATENT DOCUMENTS 5,694,818 A * 12/1997 Nickipuck ..... B25B 13/461 403/97
6,877,404 B2 * 4/2005 Chen ..... B25G 1/063 81/177.7
6,883,404 B2 * 4/2005 Hsien ..... B25B 13/04 81/125.1
7,080,581 B2 * 7/2006 Reese ..... B25B 13/06 81/124.2
7,082,862 B2 * 8/2006 Lee ..... B25G 1/063 81/177.7
7,131,356 B2 * 11/2006 Lin ..... B25B 13/461 81/177.9
7,204,175 B2 * 4/2007 Hsieh ..... B25B 23/0035 81/177.2
7,318,366 B2 * 1/2008 Lee ..... B25B 13/461 403/93
7,497,149 B2 * 3/2009 Lin ..... B25B 13/461 403/109.3
8,960,056 B2 * 2/2015 Lee ..... B25B 13/08 81/177.7
9,199,363 B2 * 12/2015 Chen ..... B25B 23/0007
2005/0034573 A1 * 2/2005 Hsien ..... B25B 13/04 81/177.2

(Continued)

FOREIGN PATENT DOCUMENTS

TW I241940 10/2005

*Primary Examiner* — David B Thomas
(74) *Attorney, Agent, or Firm* — Muncy, Geissler, Olds & Lowe, P.C.

(57) ABSTRACT

A rotary wrench includes a first wrench body, a second wrench body, and an elastic member. The first wrench body has a first grip whose one end has a pivot hole. The second wrench body has a second grip whose one end has a pivot axially extending outward. The pivot is rotatably received in the pivot hole of the first grip of the first wrench body, so that the first and second wrench bodies are allowed to rotate with respect to each other and provide adjustable working angles. The elastic member is mounted around the pivot of the second wrench body, and prop between the first grip of the first wrench body and the second grip of the second wrench body, for providing an elastic resistance that holds the first and second wrench bodies in position.

3 Claims, 4 Drawing Sheets

(56) References Cited

U.S. PATENT DOCUMENTS

| | | | | |
|---|---|---|---|---|
| 2008/0141833 | A1* | 6/2008 | Shen | B25G 1/063 81/61 |
| 2008/0196559 | A1* | 8/2008 | Allan | B25B 15/02 81/177.85 |
| 2010/0107828 | A1* | 5/2010 | Huerta | B25B 13/461 81/177.9 |

* cited by examiner

ROTARY WRENCH

BACKGROUND OF THE INVENTION

1. Technical Field

The present invention relates to wrenches, and more particularly to a rotary wrench with an adjustable working angle.

2. Description of Related Art

Wrenches are commonly used when people rotate screw bolts, nuts and other workpieces that hard to rotate with bare hands. However, when operated in a constricted space or at a place with surrounding structures that hinder operational movements, a wrench requires repeated change in the angle it is gripped for having its working head closely engaged with the workpiece it is working on. Such operation is very inconvenient and troublesome to the user.

For solving this problem, Taiwan Patent No. I241940 has provided a wrench whose working head and grip are connected through a positioning rod and an adjusting rod so that the working head can be posed in different angles. Nevertheless, since the positioning rod and the adjusting rod are inclined, complicated configuration and about effort-consuming operation are unavoidable problems with the prior-art patent. Hence, the prior art needs to be improved.

SUMMARY OF THE INVENTION

The primary objective of the present invention is to provide a rotary wrench that is simple to configure and easy to operate.

For achieving the foregoing objective, the disclosed rotary wrench comprises a first wrench body, a second wrench body, and an elastic member. The first wrench body has a first working head and a first grip. The first grip has one end connected to the first working head, and has an opposite end provided with a pivot hole. The second wrench body has a second working head, a second grip, and a pivot. The second grip has one end connected to the second working head. The pivot is connected to an opposite end of the second grip and is rotatably received in the pivot hole of the first grip of the first wrench body. The elastic member is mounted around the pivot of the second wrench body, and props between the first grip of the first wrench body and the second grip of the second wrench body.

Thereby, the first and second wrench bodies are allowed to rotate with respect to each other and provide adjustable working angles. When adjusted to the desired working angles, the wrench bodies are held in position by the elastic resistance from the elastic member.

DETAILED DESCRIPTION OF THE INVENTION

Figure 1:
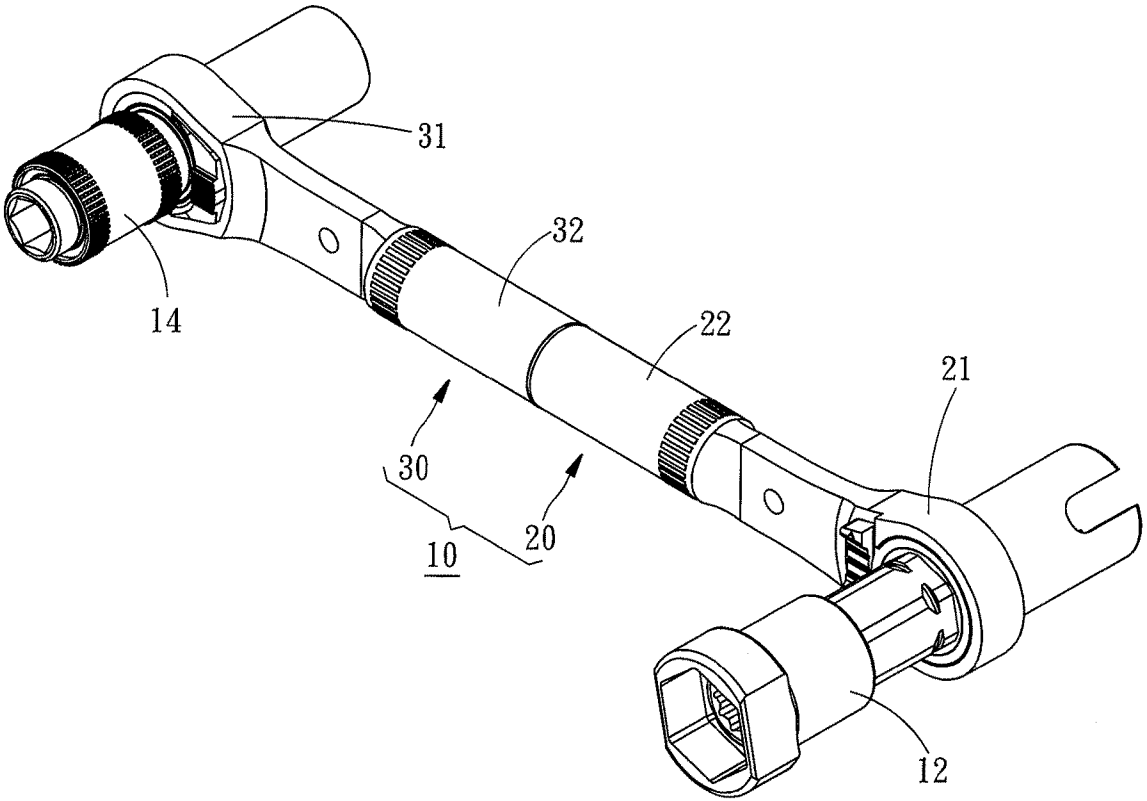
FIG. 1 is a perspective view of the present invention.
Figure 2:
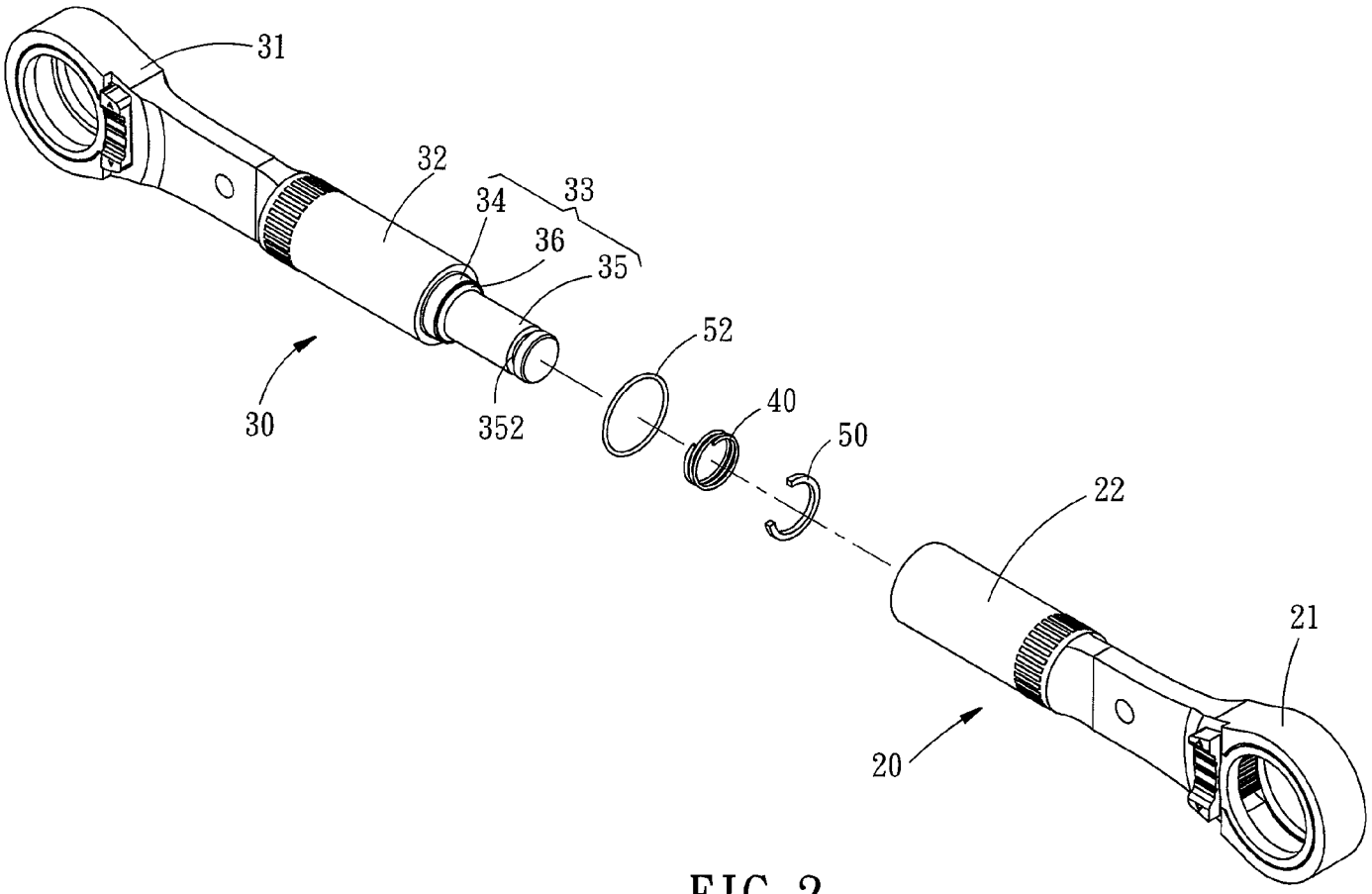
FIG. 2 is an exploded view of the present invention.

Referring to FIG. 1 and FIG. 2, according to the present invention, a rotary wrench 10 comprises a first wrench body 20, a second wrench body 30, and an elastic member 40.

Figure 3:
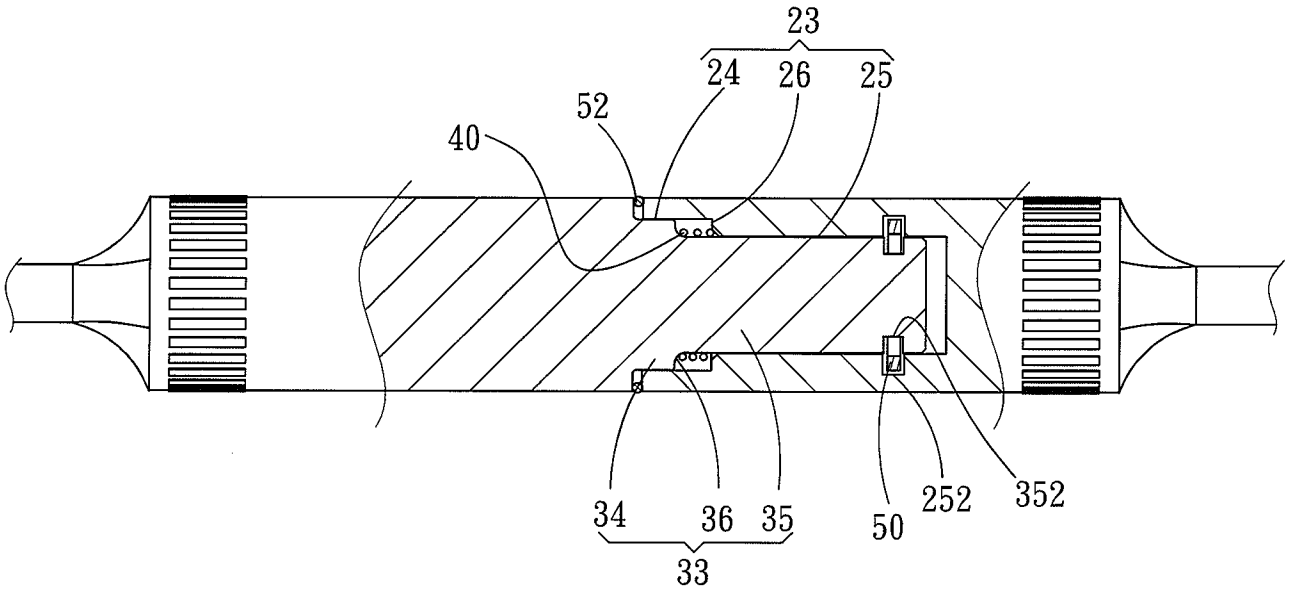
FIG. 3 is a lengthwise cross-sectional view of the present invention.

The first wrench body 20 has a first working head 21 and a first grip 22. The first working head 21 may have a ratchet socket 12 inserted therein according to practical needs. The first grip 22 has its one end connected to the first working head 21, and has its opposite end provided with a pivot hole 23, as shown in FIG. 3. The pivot hole 23 has a large hole section 24, a small hole section 25, and a first stepped portion 26 transitionally joining the large and small hole sections 24, 25. The small hole section 25 further has an inner annular groove 252.

The second wrench body 30 has a second working head 31 and a second grip 32. The second working head 31 may have another ratchet socket 14 inserted therein according to practical needs. The second grip 32 has its one end connected to the second working head 31, and has its opposite end including a pivot 33 axially extending outward. The pivot 33 passes through the pivot hole 23 of the first grip 22 of the first wrench body 20, and includes a large pivot section 34, a small pivot section 35, and a second stepped portion 36 transitionally joining the large and small pivot sections 34, 35. At the end of the small pivot section 35, an outer annular groove 352 is formed. To assemble the wrench, a C-ring 50 is arranged between the inner and outer annular grooves 252, 352, so that the combined first and second wrench bodies 20, 30 are allowed to rotate with respect to each other but are prevented from axial movement. It is to be further stated that for preventing the first and second wrench bodies 20, 30 from external dust and moisture that may otherwise adversely affect smooth rotation of the first and second wrench bodies 20, 30, an O-ring 52 is provide in the large pivot section 34 of the pivot 33 of the second wrench body 30, so that the O-ring 52 props between the end surface of the first grip 22 of the first wrench body 20 and the end surface of the second grip 32 of the second wrench body 30, thereby making the assembly waterproof and dustproof.

The elastic member 40 (herein being a compression spring for example) is mounted around the pivot 33 of the second wrench body 30 and props between the first stepped portion 26 of the first wrench body 20 and the second stepped portion 36 of the second wrench body 30, as shown in FIG. 3, for providing elastic resistance to the first and second wrench bodies 20, 30.

Figure 4:
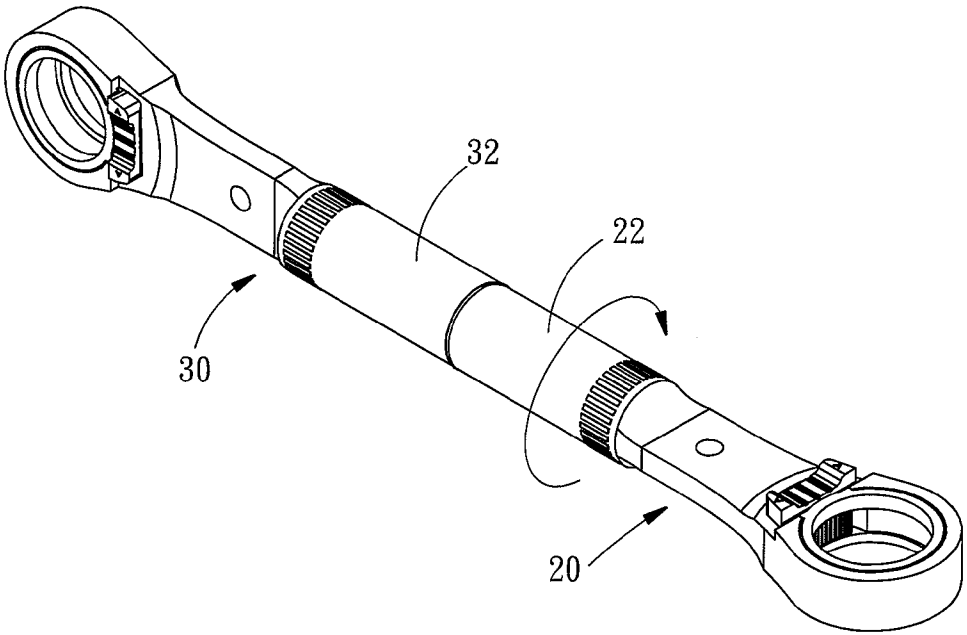
FIG. 4 is another perspective view of the present invention in a different position.

When there is a need to adjust the working angles of the working heads 21, 31, a user may first use his/her both hands to hold the first grip 22 of the first wrench body 20 and the second grip 32 of the second wrench body 30, respectively, and then apply force to rotate the first and second wrench bodies 20, 30 with respect to each other. After the desired pose of the wrench is accomplished, the user stops applying rotational force to the first and second wrench bodies 20, 30, so that the first and second wrench bodies 20, 30 get positioned by the elastic resistance from the elastic member 40, as shown in FIG. 4. At this time, the adjustment of working angles is completed. With the configuration described above, as compared to the prior-art devices, the disclosed rotary wrench 10 has a simplified structure and is more effort-consuming to operate, thereby being more convenient in use.

What is claimed is:

1. A rotary wrench, comprising:

a first wrench body, having a first working head and a first grip, wherein the first grip has one end thereof connected to the first working head and an opposite end thereof provide with a pivot hole;

a second wrench body, having a second working head, a second grip, and a pivot, the second grip having one end thereof connected to the second working head and an opposite end thereof connected to the pivot, wherein the pivot is rotatably received in the pivot hole of the first grip of the first wrench body; and an elastic member, being mounted around the pivot of the second wrench body and propping between the first grip of the first wrench body and the second grip of the second wrench body;

wherein the pivot hole of the first wrench body includes a large hole section, a small hole section, and a first stepped portion transitionally joining the large and small hole sections, while the pivot of the second wrench body includes a large pivot section, a small pivot section, and a second stepped portion transitionally joining the large and small pivot sections, in which two ends of the elastic member abut against the first and second stepped portions, respectively.

2. The rotary wrench of claim 1, further comprising an O-ring mounted around the large pivot section of the pivot of the second wrench body, wherein the O-ring props between an end surface of the first grip of the first wrench body and an end surface of the second grip of the second wrench body.

3. The rotary wrench of claim 1, wherein the small hole section of the pivot hole of the first grip has an inner annular groove, and the small pivot section of the pivot of the second grip has an outer annular groove, while a positioning ring is fitted between the inner and outer annular grooves.

* * * * *